United States Patent [19]

Puntillo

[11] 4,101,046

[45] Jul. 18, 1978

[54] PAINT BRUSH HOLDER

[76] Inventor: Theodore F. Puntillo, 5706 28th St., Sacramento, Calif. 95824

[21] Appl. No.: 783,512

[22] Filed: Mar. 31, 1977

[51] Int. Cl.[2] ..... A46B 17/02; B44D 3/12

[52] U.S. Cl. ..... 220/90; 248/110

[58] Field of Search ..... 15/257.05; 220/90; 248/110, 111, 113

[56] References Cited

U.S. PATENT DOCUMENTS

| | | | |
|---|---|---|---|
| 2,745,570 | 5/1956 | Miller | 220/90 |
| 2,803,374 | 8/1957 | Cash | 220/90 |
| 3,133,668 | 5/1964 | Heise | 220/90 |
| 3,729,158 | 4/1973 | Nagy | 248/110 |

*Primary Examiner*—Daniel Blum
*Attorney, Agent, or Firm*—Edwin E. Greigg

[57] ABSTRACT

A paint brush holder according to the invention is provided with a base having a lip which is complemental to the chime of a paint can and includes a cradle having a flat edge at its juncture with the base and offstanding at an acute angle with respect to the base, a brush retention means associated with an upper extremity of the cradle to support a paint brush by the metal band thereon, the flat edge of the cradle at the juncture of cradle and base providing for wiping excess paint from a brush dipped in the paint can.

4 Claims, 6 Drawing Figures

FIG. 1
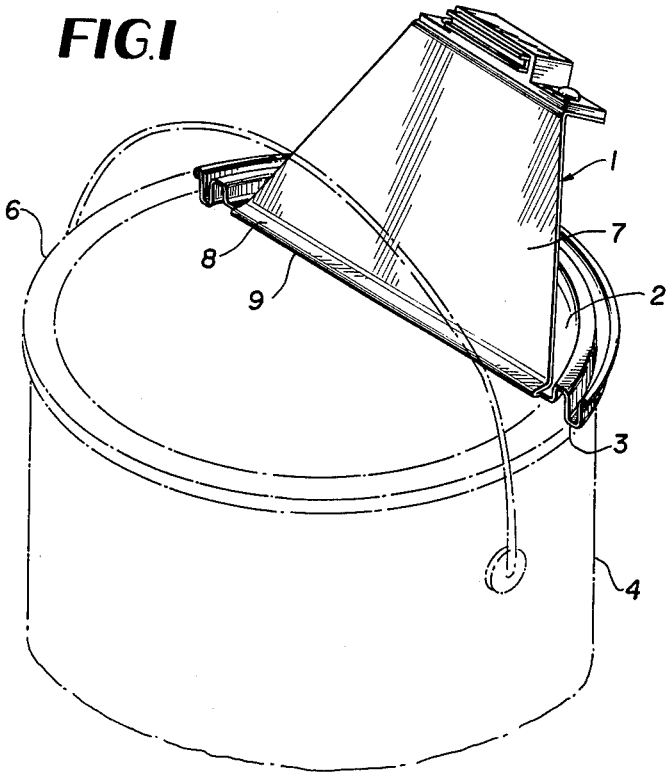
FIG. 2
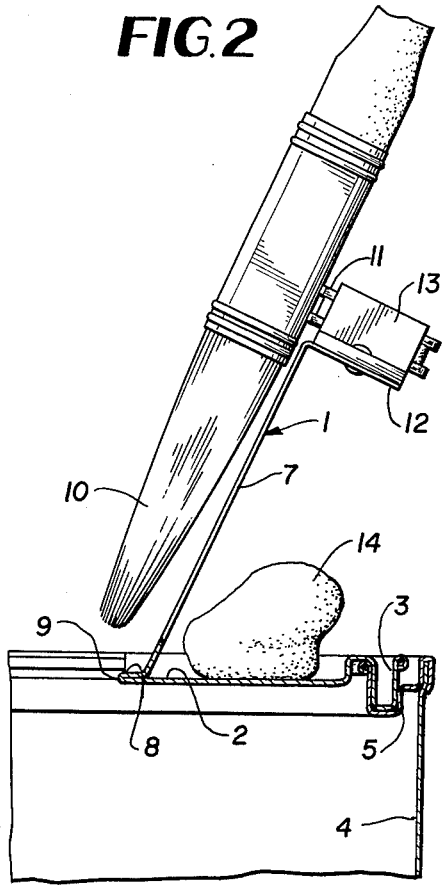
FIG. 3
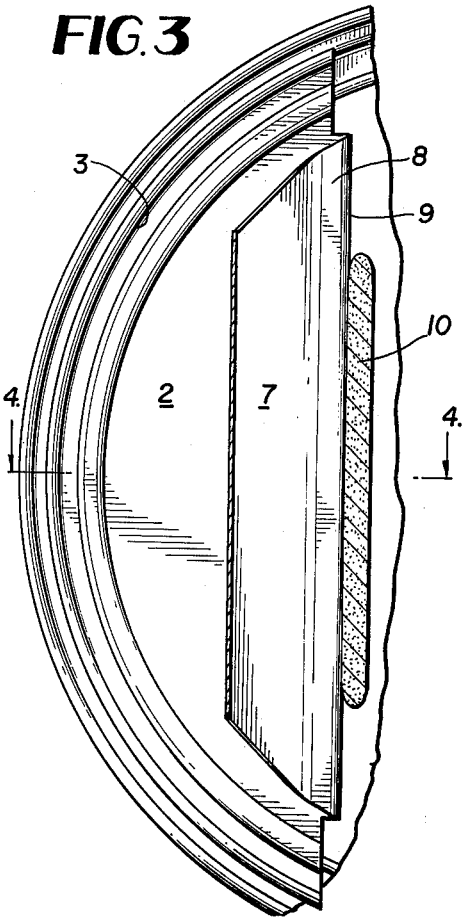
FIG. 5
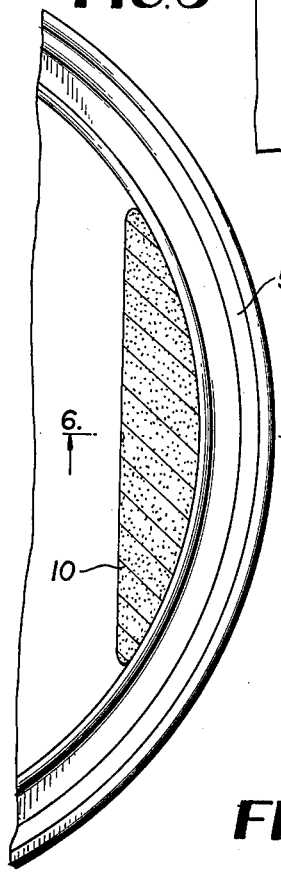
FIG. 4
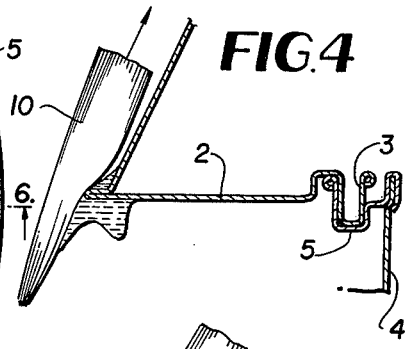
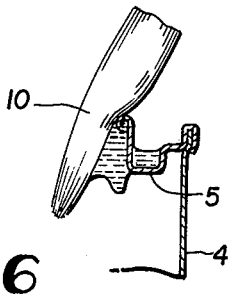
FIG. 6

PAINT BRUSH HOLDER

BACKGROUND OF THE INVENTION

This invention is directed to improvements in paint brush holders for paint cans and more particularly comprises an integral attachment, easily applied to and removed from a paint can, which serves to hold a paint brush ready for use as well as to provide a wiping surface for the bristles of the brush, and to allow for storage of the paint brush so that its handle remains clean and paint-free.

Paint brush holders which are arranged to be secured to paint cans for supporting a brush preparatory for use are old and well-known in the prior art. One example of this type of holder is shown in the patent to David Nagy, U.S. Pat. No. 3,729,158, which illustrates a paint brush elevating device that is arranged to grasp a paint brush by a magnet. This patented device is in the form of an L-shaped bracket which is adjustably clamped to a paint can by thumb screw means. No hint of the bracket being adapted to wiping the brush is given in that patent and, obviously from the structure disclosed therein, such a use therefor was never considered by the patentee. The patent to Ralph Anderson, U.S. Pat. No. 2,715,478, shows a flat trough member mounted horizontally at the top edge of a paint can and retained in contact therewith by an angular lip that projects under the chime and this lip, together with an exteriorly mounted camming means, retains the holder to the paint can. This patent discloses that the forward edge of the holder may be used to wipe excess paint from the freshly-dipped bristles of a paint brush, but provides neither for positive means of brush retention, nor for elevated drainage thereof while the brush is held in a position ready for use.

OBJECTS AND SUMMARY OF THE INVENTION

The instant invention has for its principal object the provision of an elevated brush support means as well as a built-in wiping means therefor.

Another object of the invention is to provide a simple unitary structure which is arranged to cooperate with the chime of a paint can in the same fashion as does the lid therefor.

A further object of the invention is to provide a one-piece structure which can be manufactured simply and inexpensively of plastic or metallic material.

A still further object of the invention is to provide a use for waste material such as discardable paint can lids from which the structure disclosed herein can be manufactured.

Other objects and advantages of the present invention will be more readily apparent from a further consideration of the following detailed description of the drawings illustrating a preferred embodiment of the invention, in which:

BRIEF DESCRIPTION OF THE DRAWINGS

FIG. 1 shows a perspective view of a paint brush holder, according to the preferred embodiment of the invention;

FIG. 2 is a side elevational view of the holder, according to the invention, mounted on a paint can;

FIG. 3 is a partial top plane view of the holder and a brush in contact therewith;

FIG. 4 is a cross-sectional view on line 4—4 of FIG. 3;

FIG. 5 is a partial top plan view of a brush in wiping contact with a paint can as is standard practice; and FIG. 6 is a fragmentary, cross-sectional elevational view on line 6—6 of FIG. 5.

DESCRIPTION OF THE PREFERRED EMBODIMENTS

FIG. 1 shows a magnetic paint brush holder 1, which according to the invention, is provided with a base element 2, having a dependent lip-shaped portion 3, which extends downwardly from the base. This lip portion 3 has a shape substantially corresponding to that of the lid for the paint can 4, which is shaped complementally to the chime 5, of a paint can so that the lid, or the lip of the brush holder, may be received and securely retained therein. It is known, of course, that the chime extends fully around the paint can and has a circumference 6, which is substantially that of the circumference of the can. This fact allows for the brush holder of this invention to be mounted upon the can at any circumferential location thereon, whereupon the base element of the brush holder covers substantially one third of the circumference of the chime. With the holder mounted in the manner clearly shown in FIG. 1, most of the mouth of the can remains open for access to the supply of paint and for entry of a brush for dipping. In addition, the bail of the paint can can be used as a handle without contact of the painter's hand with the brush holder or a brush supported thereon.

FIG. 2 best shows the offstanding cradle means 7 inclined upwardly at an acute angle from the base element 2. At its juncture 8 with the base element, the cradle means 7 is reinforced and strengthened by welding, soldering or any other suitable process. The base element is conjoined to the cradle means by a reentrant lip portion. The leading edge 9 of the juncture between the cradle means 7 and the base element 2 is flat to form a wiping surface for a paint brush 10 which, when the brush is urged thereagainst and then moved upwardly by the painter, will function to remove any excess paint from the bristles. This Figure also shows the brush retention means which comprises a magnet 11 that is mounted on an upper extremity of the cradle means 7. This upper extremity, in the preferred embodiment of the invention, represents a perpendicular extension 12 that offstands from the cradle means 7. A suitable bracket 13 is attached to the extension 12 for securely supporting the magnet 11. Base 2 may store putty 14.

FIG. 3 illustrates the distinct advantage over any of the known prior art structures that is presented by the flat wiping surface 9 for the brush 10 over conventional usage of the chime of the paint can as a wiping surface, as shown in FIG. 5. The flat edge 9 forms a more effective wiping surface than does the rounded chime of the can.

FIG. 4 is a side view of FIG. 3, showing the efficient cooperation between the paint brush 10 and wiping edge 9 achieved in the instant invention, especially over the conventional usage of the top of the paint can as a wiping surface, which, as shown in FIG. 6, allows paint to accumulate in the chime, rendering the paint can lid difficult to apply as well as to remove upon attempted reuse of the contents.

Relative to the view in FIG. 6, it is to be understood that the paint can 4 provided with the chime 5 is of the conventional kind. Inventors have long recognized the need for improvements to be made in the customary paint can, which many use in the course of painting rather than buying the conventional paint bucket that has an outwardly rolled edge or rim portion that professional painters use during painting. There are already revealed in the patented prior art paint cans which have the trough portion perforated so that paint which is wiped from the brush, as illustrated in FIG. 6, will not clog the trough and overflow down the exterior of the paint can when the top is reapplied after use of the contents of the paint can as a substitute for a bucket.

The foregoing description is meant to be illustrative, and not delimiting of the modifications and further embodiments which can be made in the invention without departing from the spirit and scope thereon.

What is claimed is:

1. A paint brush holder comprising a wide base element provided with a dependent lip-shaped portion complemental to a chime of a paint can arranged for association therewith, said chime having a circumference, a wide upstanding cradle means including an upper terminal portion and a planar portion offset from a juncture with said base element at an acute angle with respect thereto, the juncture of said cradle means with said base element being provided with a flat edge portion against which a paint brush may be moved in an upward direction for removing excess pain therefrom, and retention means for releasably holding said paint brush spaced from said edge portion secured to said upper terminal portion of said cradle means, said dependent lip-shaped portion of said base element circumscribing an arc at the least of substantially one-third of the circumference of the chime of said paint can.

2. A paint brush holder as claimed in claim 1, wherein said retention means includes a transverse extension with a bracket member for supporting a magnetic means thereon.

3. A paint brush holder as claimed in claim 1, wherein the upper terminal portion of said cradle includes a portion that is bent at an angle relative to said plane, and said retention means includes a magnet that interrupts said plane of said cradle means.

4. A paint brush holder as claimed in claim 1, wherein said base element is conjoined to said cradle means by a reinforced re-entrant lip portion that serves as the said flat edge portion.

* * * * *